US005561243A

United States Patent [19]

Machida

[11] Patent Number: 5,561,243

[45] Date of Patent: Oct. 1, 1996

[54] APPARATUS AND METHOD FOR DIAGNOSING RADIATOR FAN CONTROL SYSTEM INSTALLED IN VEHICULAR INTERNAL COMBUSTION ENGINE

[75] Inventor: Kenichi Machida, Atsugi, Japan

[73] Assignee: Unisia Jecs Corporation, Atsugi, Japan

[21] Appl. No.: 408,830

[22] Filed: Mar. 23, 1995

[30] Foreign Application Priority Data

Mar. 23, 1994 [JP] Japan ..... 6-052178

[51] Int. Cl.[6] ..... G01M 15/00; F01P 7/02

[52] U.S. Cl. ..... 73/118.1; 123/41.12

[58] Field of Search ..... 73/118.1, 45.8, 73/49.7, 117.2, 119 R; 123/41.01, 41.05, 41.12, 41.46, 41.47, 41.49

[56] References Cited

U.S. PATENT DOCUMENTS

| | | | |
|---|---|---|---|
| 4,409,933 | 10/1983 | Inoue | 123/41.12 |
| 4,425,766 | 1/1984 | Claypole | 123/41.12 |
| 4,469,053 | 9/1984 | Sakurai | 123/41.12 |
| 4,475,485 | 10/1984 | Sakakibara et al. | 123/41.05 |
| 4,489,680 | 12/1984 | Spokas et al. | 123/41.05 |
| 4,559,907 | 12/1985 | Hayashi | 123/41.12 |
| 4,651,922 | 3/1987 | Noba | 123/41.12 |
| 4,658,765 | 4/1987 | Hayashi | 123/41.21 |
| 4,662,317 | 5/1987 | Ogawa | 123/41.21 |
| 4,677,941 | 7/1987 | Kurz | 123/41.49 |
| 4,691,668 | 9/1987 | West | 123/41.12 |
| 4,765,284 | 8/1988 | Kanazawa et al. | 123/41.12 |
| 4,955,431 | 9/1990 | Saur et al. | 123/41.49 |
| 4,962,734 | 10/1990 | Jorgensen | 123/41.49 |
| 4,977,862 | 12/1990 | Aihara et al. | 123/41.12 |
| 5,018,484 | 5/1991 | Naitoh | 123/41.12 |
| 5,036,803 | 8/1991 | Nolting et al. | 123/41.05 |
| 5,133,302 | 7/1992 | Yamada et al. | 123/41.12 |
| 5,215,044 | 6/1993 | Banzhaf et al. | 123/41.1 |
| 5,307,644 | 5/1994 | Cummins et al. | 123/41.12 |
| 5,359,969 | 11/1994 | Dickrell et al. | 123/41.01 |
| 5,415,134 | 5/1995 | Stewart, Jr. | 123/41.01 |

OTHER PUBLICATIONS

Service Manual of a New Model of C34, (C34–1), "7–5 Radiator Fan Control System", pp. B–122, (Jan. 1993).

*Primary Examiner*—Richard Chilcot
*Assistant Examiner*—Eric S. McCall
*Attorney, Agent, or Firm*—Foley & Lardner

[57] ABSTRACT

In apparatus and method for diagnosing radiator fan control system installed in a vehicular internal combustion engine, an engine coolant temperature Tw is detected and a failure in the radiator fan control system is determined when the detected engine coolant temperature Tw indicates a predetermined rise state and/or when a predetermined engine driving condition is detected, the predetermined engine driving condition being varied in correlation to a variation in an electrical load to the engine, and a variation width (drop width) in the detected engine driving condition is below a reference value during a switching of a rotation speed of a radiator fan by means of the radiator fan control system.

14 Claims, 7 Drawing Sheets

APPARATUS AND METHOD FOR DIAGNOSING RADIATOR FAN CONTROL SYSTEM INSTALLED IN VEHICULAR INTERNAL COMBUSTION ENGINE

BACKGROUND OF THE INVENTION:

1. Field of The Invention

The present invention relates to an apparatus and method for diagnosing a radiator fan control system installed in a vehicular internal combustion engine. Particularly, the present invention relates to the apparatus and method for diagnosing a cooling function of a radiator ran unit carried out by means of the radiator fan in the radiator fan control apparatus on the basis of a coolant temperature of an engine coolant.

2. Description of Background Art

Generally, an engine coolant is circulated through a vehicular internal combustion engine so as to cool the engine and is returned to a radiator. The coolant cooled by means of a heat exchange at the radiator is again circulated through the engine. This is called a water cooling type cooling system.

There is an automotive vehicle which is provided with a DC motor installed radiator fan unit in order to promote the heat exchange in the radiator.

A control unit is provided to perform an on-and-off control for the DC motor so that the cooling to the engine is appropriately carried out. In addition, a rotation speed of the DC motor is controlled at a plurality of stages so that a more precise temperature control for the engine coolant is achieved.

If, in the cooling system in which the DC motor installed radiator fan is installed, a broken line in a DC motor radiator fan driving system occurs and/or a failure occurs in a relay part of the DC motor radiator fan driving system, the radiator fan cannot be operated (driven to rotate) any more and, consequently, an excessive rise in the coolant temperature would be resulted even if a control signal from the control unit normally is output to: the DC motor.

Although it is possible, for the failure such as a broken line in the DC motor fan control system, to perform an electrical failure diagnosis, an occurrence in failure such as not to make a desired cooling through the radiator fan can be predicted. Therefore, an automotive industry has demanded to provide a diagnosing apparatus which is capable of determining whether the cooling by means of the radiator fan is actually carried out or not, or in other words, whether the radiator fan is normally functioning.

SUMMARY OF THE INVENTION

It is an object of the present invention to provide an apparatus and method for diagnosing a radiator fan control system installed in a vehicular internal combustion engine :which are capable of determining whether a cooling of the engine by means of a radiator fan is actually carried out and the radiator fan is exhibiting a desired cooling function.

The above-described object can be achieved by providing a diagnostic apparatus for a radiator fan control system, said radiator fan control system having a radiator fan which is so constructed and arranged on a vehicular internal combustion engine as to cool an engine coolant of the engine and a DC motor which is so constructed and arranged on a shaft of the radiator fan as to drive the radiator fan to rotate to effectively cool the coolant, said diagnostic apparatus comprising: a) coolant temperature detecting means for detecting a coolant temperature of the engine and outputting a signal indicative of the detected coolant temperature; b) radiator fan control means for controlling a fan speed of the radiator fan on the basis of the detected coolant temperature indicative signal; and c) failure diagnosing means for outputting a failure determination signal indicating that the radiator fan control system has failed when the detected coolant temperature signal indicates a predetermined temperature rise state.

The above-described object can also be achieved by a diagnostic apparatus for a radiator fan control system, said radiator fan control system having a radiator fan which is so constructed and arranged on a vehicular internal combustion engine as to cool an engine coolant of the engine and a DC motor which is so constructed and arranged on a shaft of the radiator fan as to drive the radiator fan to rotate to cool the coolant, said diagnostic apparatus comprising: a) coolant temperature detecting means for detecting a coolant temperature of the engine and outputting a signal indicative of the detected coolant temperature; b) radiator fan control means for controlling a fan speed of the radiator fan on the basis of the detected coolant temperature indicative signal; c) engine driving condition detecting means for detecting a predetermined driving condition which is varied in correlation to a variation in an electrical load of the engine; and d) failure diagnosing means for determining whether a drop depth of the predetermined driving condition is below a reference value of the drop depth or not when a radiator fan speed is switched from a first predetermined operation mode to a second predetermine operation mode and for outputting a failure determination signal indicating that the radiator fan control system has failed when the drop depth of the predetermined driving condition is below the reference value of the drop depth.

The above-described object can also be achieved by a diagnostic method for a radiator fan control system, said radiator fan control system having a radiator fan which is so constructed and arranged on a vehicular internal combustion engine as to cool an engine coolant of the engine and a DC motor which is so constructed and arranged on a shaft of the radiator fan as to drive the radiator fan to rotate to effectively cool the coolant, said diagnostic method comprising the steps of: a) detecting a coolant temperature of the engine and outputting a signal indicative of the detected coolant temperature; b) controlling a fan speed of the radiator fan on the basis of the detected coolant temperature indicative signal; and c) outputting a failure determination signal indicating that the radiator fan control system has failed when the detected coolant temperature signal indicates a predetermined temperature rise state.

BEST MODE CARRYING OUT THE INVENTION

Reference will hereinafter be made to the drawings in order to facilitate a better understanding of the present invention.

Figure 1:
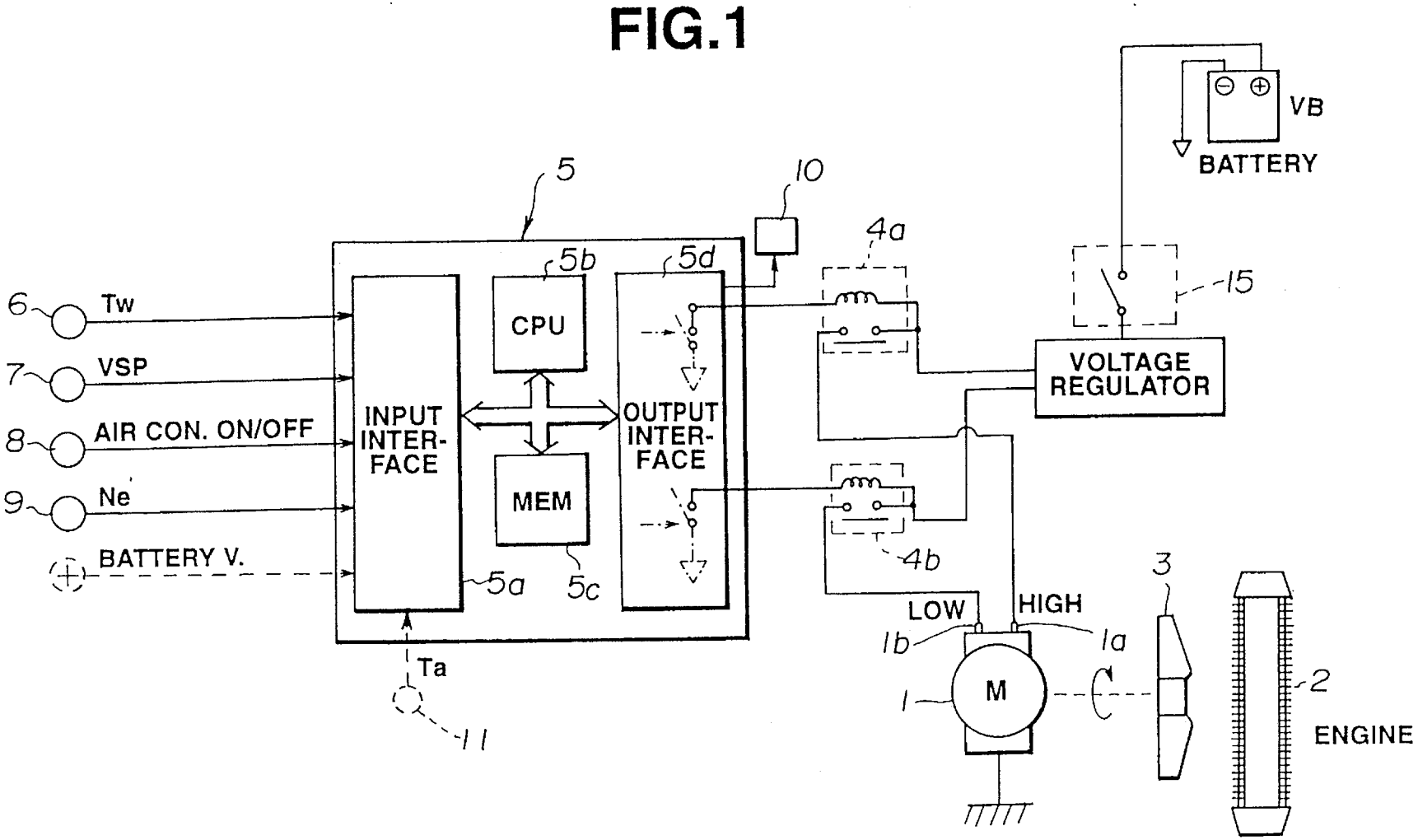
FIG. 1 is a circuit block diagram of a radiator fan control system of a vehicular internal combustion engine in a preferred embodiment to which its diagnosing apparatus and method according to the present invention is applicable.

FIG. 1 shows a preferred embodiment of a diagnosing apparatus for a radiator fan control system installed in a vehicular internal combustion engine according to the present invention.

A DC motor 1 is a motor for a radiator fan 3 used for a radiator 2 in which an engine coolant is used for cooling an internal combustion engine mounted in an automotive vehicle (not shown), as shown in FIG. 1.

The DC motor 1 is provided with a high input voltage terminal High 1*a* and a low input voltage terminal LOW 1*b*, so that a rotation speed of the radiator fan 3 is controlled at the high and low stages (i.e., high rotation mode speed mode and low rotation mode).

The high input voltage terminal 1*a* of the DC motor 1 receives a power supply having a predetermined high voltage via a voltage regulator and a high voltage relay part 4*a* from a vehicular DC battery VB. In addition, the low input voltage terminal 1*b* of the DC motor 1 receives a power supply having a predetermined low voltage via the voltage regulator and a low voltage relay part 4*b* from the vehicular DC battery VB.

A control unit 5 includes a microcomputer having an input interface 5*a*, a CPU (Central Processing Unit) 5*b*, a MEM (Memory) 5*c*, an output interface 5*d*, and a common bus interconnecting each circuitry of the microcomputer. The control unit 5 serves to perform on-and-off controls for the respective relay parts 4*a* and 4*b*, mutually independently. When the control unit 5 switches the relay parts 4*a* and 4*b* to off states, the DC motor 1 naturally stops and the radiator fan 3 rotatably disposed on an output shaft of the DC motor 1 has accordingly stopped.

On the other hand, when the control unit 5 switches only the high voltage relay part 4*a* to be in the on state, the radiator fan 3 is driven to rotate at a predetermined high rotation speed. When the control unit 5 switches only the low voltage relay part 4*b* to be in the on state, the radiator fan 3 is driven to rotate at a predetermined low rotation speed.

An ignition switch 15 is interposed between the vehicular DC battery and the voltage regulator, as shown in FIG. 1.

The control unit 5 receives detection signals from various sensors 6, 7, 8, and 9 and serves to perform the on-and-off controls for the relay parts 4*a* and 4*b* on the basis of the detection signals in order to maintain a temperature of the engine coolant at an appropriate range.

The various sensors include a coolant temperature sensor 6 which is so constructed and arranged as to detect the coolant temperature Tw, a vehicle speed sensor 7 which is so constructed and arranged as to detect the vehicular speed VSP, and an air conditioner switch 8 which is so constructed and arranged as to indicate on or off state of an air conditioner compressor.

Figure 2:
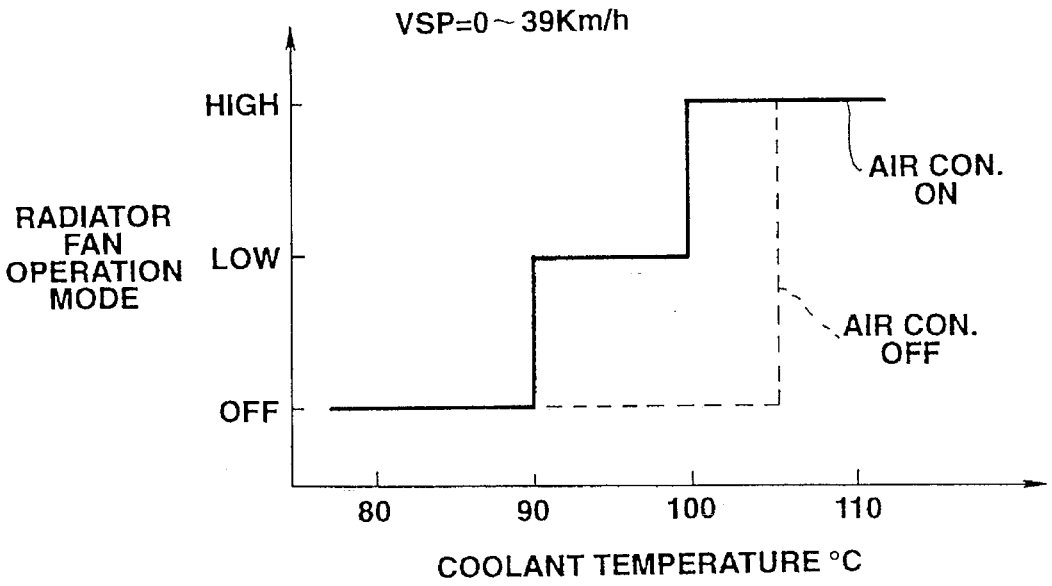
FIG. 2 is a characteristic graph of radiator fan operation modes in a radiator fan control system carried out in the preferred embodiment shown in FIG. 1 when a vehicular speed falls in a range from 0 to 39 Km/h.
Figure 3:
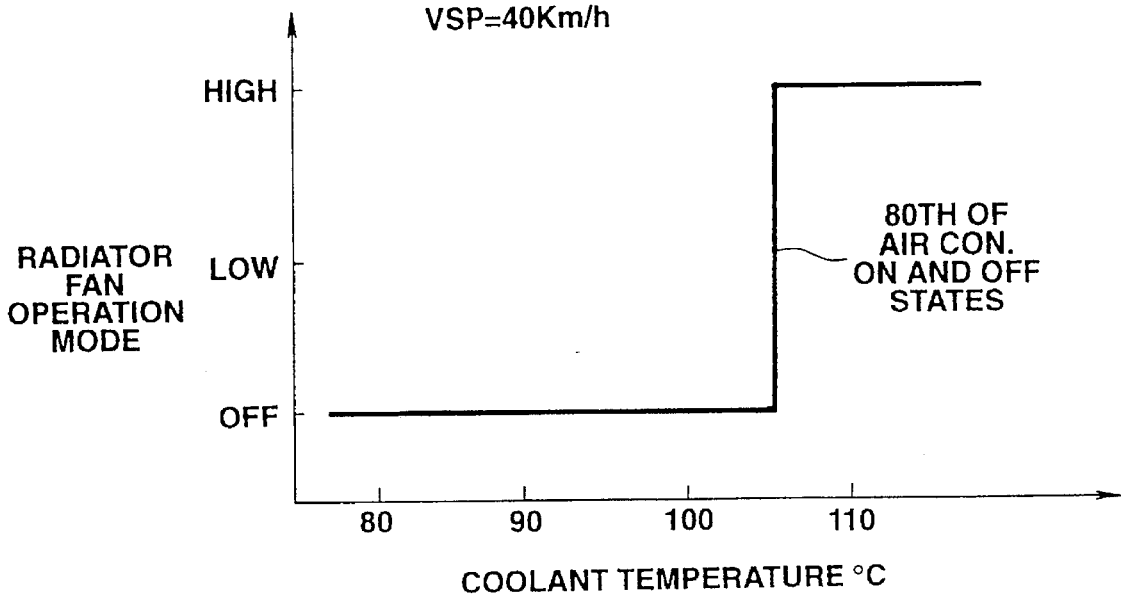
FIG. 3 is a characteristic graph of the radiator fan operation modes in a radiator fan control system carried out in the preferred embodiment shown in FIG. 1 when the vehicular speed falls in a range equal to or above 40 Km/h.

FIGS. 2 and 3 show table maps stored in the memory 5*c* of the control unit 5 indicating radiator fan operation modes of a stop, a predetermined low rotation speed, and a predetermined high rotation speed, each of which is changed on the basis of the coolant temperature Tw, the vehicular speed VSP, and the air conditioner switch on or off. The CPU 5*b* serves to output a control signal to either of the relay parts 4*a* or 4*b* via the output interface 5*d* so as to perform the on-or-off control for either of the relays 4*a* or 4*b*, referring to the table maps shown in FIGS. 2 and 3.

In details, the table map shown in FIG. 2 is a map to which the control unit 5 is to refer when the vehicle speed VSP indicates a speed range from 0 to a predetermined speed limit, for example, 39 Km/h. When the air conditioner compressor switch 8 is in the off state, the radiator fan 3 is driven to rotate at the high rotation speed when the engine coolant temperature Tw is equal to or above a predetermined temperature, for example, 105° C. However, when the engine coolant temperature is below the predetermined temperature, the control unit 5 is operated to stop the radiator fan 3.

On the other hand, when the air conditioner switch 8 is in the on state, the coolant temperature Tw is divided into three regions; when the engine coolant temperature Tw is below a predetermined temperature limit, for example, 90°, the radiator fan 8 is stopped. When the engine coolant temperature Tw falls in an intermediate range from equal to or above 90° below 100° C., the radiator fan 3 is driven to rotate at the predetermined low rotation speed, and when the coolant temperature Tw falls in a high temperature range, for example, equal to or above 100° C., the radiator fan 3 is driven to rotate at the predetermined high rotation speed.

In addition, the table map shown in FIG. 3 is a map to which the control unit 5 is to refer when the vehicle speed VSP indicates a speed value of a speed range which is higher than a predetermined speed limit, for example, 40 Km/h. Regardless of whether the air conditioner compressor switch 8 is in the on or off state, the switching control such that the radiator fan 3 is in the stopped state (mode) or high rotation state (mode) is carried out with the coolant temperature Tw, for example, 105° C. as a boundary.

As described above, a reason of change in rotation speed characteristics of the radiator fan 3 depending upon the vehicle speed VSP is that a cooling effect of the radiator 2 caused by a vehicular running wind (a wind generated when the vehicle runs) is varied according to the vehicle speed.

Figure 4:
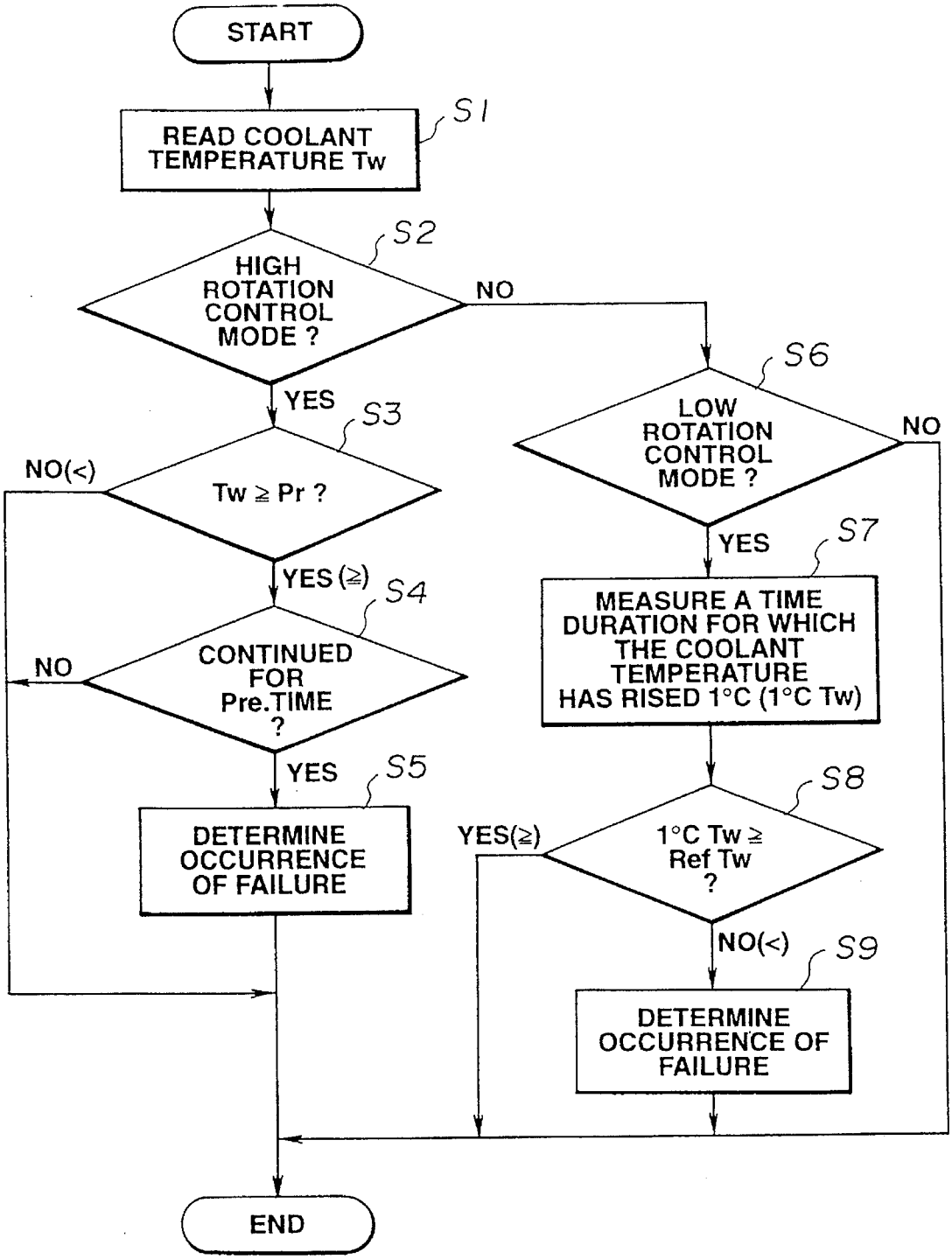
FIG. 4 is an operational flowchart representing a diagnosing operation in the diagnosing apparatus and method in tile preferred embodiment shown in FIG. 1.

In the preferred embodiment, the control unit 5 stores a program flowchart shown in FIG. 4 in accordance with which the control unit carries out a self-diagnostic operation to determine whether a cooling function of the radiator fan 3 for the engine coolant is normally functioning.

In FIG. 4, at a step S1, the control unit 5 (the CPU 5*b*) reads the coolant temperature Tw detected by the coolant temperature sensor 6 (via the input interface 5*a*).

At a step S2, the CPU 5b determines whether the radiator fan 3 is rotating at the predetermined high speed (high speed rotation mode).

If Yes at the step S2, namely, the relay part 4a is turned on so that the DC motor 1 receives the predetermined high voltage, the routine goes to a step S3 in which the CPU 5b determines whether the engine coolant temperature Tw is equal to or above a predetermined value Pt. The predetermined value Pr is a temperature condition when the radiator fan 3 is controlled in the high rotation speed control mode.

In a case where the rotation speed control is carried out in the characteristic shown in FIG. 3, the engine coolant temperature Tw is preferably maintained at, for example, 105° C. regardless of the on or off state of the air conditioner compressor switch 8.

Since, in a case where the rotation speed control is carried out in the characteristic shown in FIG. 2, the temperature conditions at which the coolant temperature Tw is maintained in the high rotation speed control mode are different according to the turn on or off of the air conditioner switch 8, the predetermined temperature value Pr may be varied as a minimum temperature above which the high rotation speed control is carried out.

In the preferred embodiment, the temperature condition of the engine coolant temperature Tw under which the radiator fan 3 is controlled to rotate at the predetermined high speed is such a temperature region that the coolant temperature Tw exceeds the appropriate range and the heat exchange in the radiator 2 is sufficiently promoted so as to provide a reduction in the coolant temperature Tw (reduction of the high rotation control below the above-described temperature region) with the radiator fan 3 being driven to rotate at the predetermined high rotation speed. It is noted that a radiator capacity and a rotation number of times per time by which the radiator fan 3 is rotated are set when, in the normal case, a certain period of time has passed with the radiator fan 3 driven to rotate at the high rotation speed, the engine coolant temperature Tw is reduced toward a temperature range not necessary for the radiator fan 3 to be driven to rotate at the high rotation speed.

Figure 5:
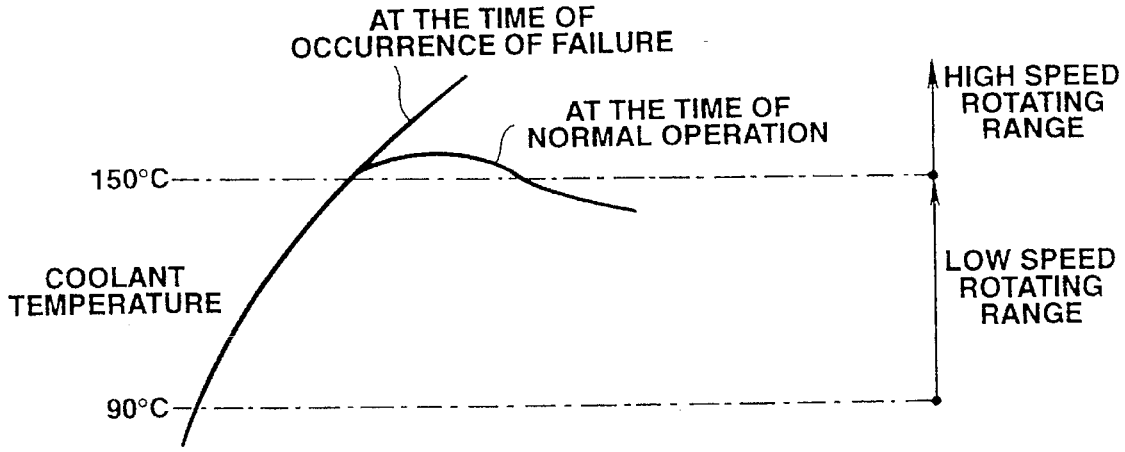
FIG. 5 is a characteristic graph of a coolant temperature when the radiator fan has normally operated and when the radiator fan has failed.

Hence, in cases where the radiator fan 3 is normally driven to rotate at the predetermined high rotation speed and a blowing of wind through the radiator fan 3 which corresponds to the related high rotation speed drive is actually carried out, the temperature condition under which radiator fan 3 is driven to rotate at the predetermined high speed range is not continued for the certain period of time (refer to FIG. 5).

At the step S3, if the CPU 5b determines that the engine coolant temperature Tw is the temperature condition at which the radiator fan 3 is driven to rotate at the predetermined high rotation speed, the routine goes to a step S4 in which the CPU 5b determines whether a time for which the temperature condition at which the radiator fan 3 is driven to rotate at the predetermined high rotation speed is equal to or above a predetermined time (Pre. Time) or not.

In a case where the coolant temperature Tw is continued at the temperature condition under which the radiator fan 3 is driven to rotate at the predetermined high rotation speed (refer to FIG. 5), the CPU 5b determines that although the relay part 4a is energized to supply the voltage regulator high output voltage to the DC motor 1, actually the cooling effect cannot be obtained which meets the condition under which the radiator fan 3 is driven to rotate at the high rotation speed. Then, the routine goes to a step S5 in which the CPU 5b outputs a failure determination signal indicating that the radiator fan control system has failed.

As shown in FIG. 1, a warning lamp 10 is installed in the vehicle (a predetermined part of an instrument panel) to receive the failure determination signal from the output interface 5d and to be turned on to inform a vehicle occupant of the occurrence of failure in the radiator fan control system.

On the other hand, in a case where the continued time for which the coolant temperature Tw is held at the temperature condition under which the radiator fan 3 is driven to rotate at the predetermined high rotation speed is below the predetermined time, the CPU 5b estimates that although the coolant temperature Tw is temporarily increased due to a high load driving of the engine, the radiator fan 3 is actually driven to rotate at the predetermined high speed so that a quick reduction of the engine coolant temperature Tw can be achieved. Consequently, the program shown in FIG. 4 is ended without: the output of the failure determination signal. That is to say, if NO at the step S4, the program is ended.

Referring back to FIG. 4, if the CPU 5b determines that the radiator fan 3 is not in the high rotation speed control state (NO at the step S2), the routine goes to a step S6.

At the step S6, the CPU 5b determines whether the radiator fan 3 is driven to rotate at the predetermined low rotation speed (low speed rotation control mode).

If the radiator fan 3 is driven to rotate at the predetermined low rotation speed with the relay part 4b energized to turn on the relay switch of the relay part 4b, namely, YES at the step S6, the routine goes to a step S7.

Figure 6:
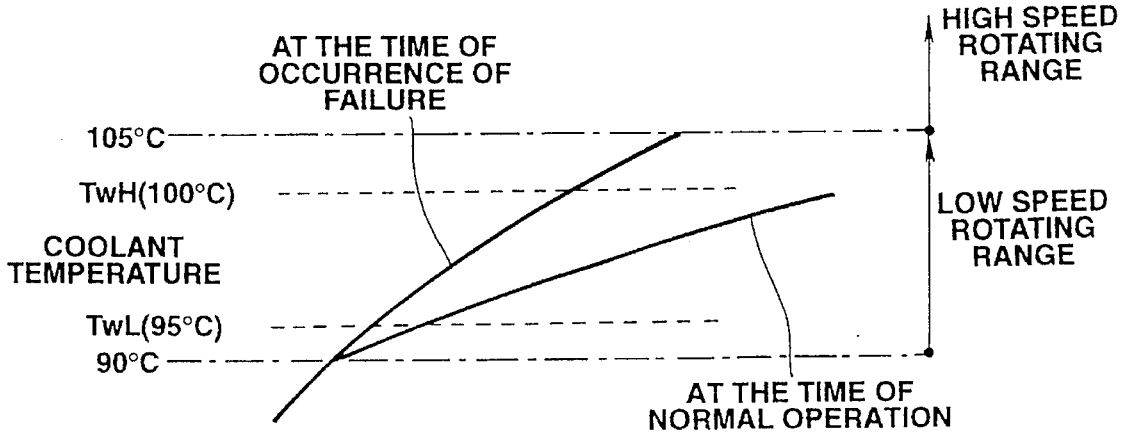
FIG. 6 is a characteristic graph of a coolant temperature when the radiator fan has normally operated and when the radiator fan has failed.

At the step S7, the CPU 5b measures a time required for the engine coolant temperature Tw to traverse a temperature range (refer to FIG. 6) having an upper limit and a lower limit, the upper limit being a first threshold value TwL and the lower limit being a second threshold value TwH (>TwL) previously set from among the temperature condition ranges in the low rotation speed control operation mode, and divides the measured time by a temperature difference (TwH–TwL) between the first and second threshold values. Consequently, the CPU 5b derives a time required for the engine coolant temperature Tw to rise by 1° C.

The engine coolant temperature range in which the radiator fan 3 is driven to rotate at the predetermined low rotation speed is a control range in which the radiator fan 3 is driven to rotate at the predetermined low rotation speed range so as to suppress the increase in the engine coolant temperature Tw, thus the engine coolant temperature Tw being prevented from abruptly falling in the other engine coolant temperature range in which the radiator fan 3 is driven to rotate at the predetermined high rotation speed. Hence, it can be estimated that if the temperature rise in the engine coolant is abrupt in spite of the predetermined low rotation speed control mode being carried out in the radiator fan control system, the desired cooling effect due to the rotation of the radiator fan 3 is actually not achieved although the relay part 4b is energized (turned on) to supply the predetermined low voltage to the DC motor 1 so that the radiator fan 3 is driven to rotate at the predetermined low rotation speed.

Then, at the step S8 next to the step S7, the CPU determines whether the time required for the engine coolant temperature Tw to rise by 1° C. (1° C. Tw) is below a predetermined time RefTw. That is to say, the CPU 5b determines whether the engine coolant temperature Tw indicates the abrupt temperature rise.

When the time required for the engine coolant temperature Tw to rise by 1° C. (1° C. Tw) is below the predetermined time RefTw, namely, the engine coolant temperature Tw is rising at a speed equal to or above a predetermined speed value at the step S8, the CPU 5*b* determines that the cooling effect which meets the condition under which the radiator fan 3 is driven to rotate at the predetermined low rotation speed is not achieved and the routine goes to a step S9.

At the step S9, the failure determination signal indicating that the radiator fan control system has failed is output. Then, the warning lamp 10 is lighted on to inform the vehicular occupant of the occurrence in failure in the radiator fan control system.

It is noted that, as a modification of the preferred embodiment, the predetermined value Pr at the step S3, the predetermined value Pre. Time at the step S4, the predetermined time Ref Tw at the step S8, and/or the predetermined speed described at the step S8 is varied according to an ambient temperature Ta detected by, e.g., an ambient temperature sensor 11 and/or vehicle speed VSP detected by the vehicle speed sensor 7 so that a more accurate failure diagnosis becomes possible.

In details, since, when the ambient (air) temperature Ta of the vehicle is relatively high or when the vehicle speed VSP is low, the coolant temperature Tw is maintained at the relatively high level and the temperature rise in the coolant temperature Tw tends to become relatively fast even if no failure in the radiator fan control system occurs.

On the other hand, when the ambient temperature Ta is relatively low or when the vehicle speed VSP is relatively high, an excessively large temperature rise does not occur even if no cooling for the engine coolant by means of the radiator fan 3 is present. Hence, when the continued time predetermined value Pre. Time at the step S4 and the temperature rise speed described at the step S8 are varied according to the ambient temperature Ta and/or vehicle speed VSP, the engine coolant temperature characteristic generated when the radiator fan control system has failed can accurately be determined.

As described above, since the failure diagnosing apparatus in the preferred embodiment determines a predetermined engine coolant temperature rise state indicating the failure in the radiator fan control system on the basis of the continuation time Pre. Time for which the engine coolant temperature Tw is continued to indicate the predetermined high engine coolant temperature and of the temperature rise speed, the function diagnosis of whether the cooling effect by means of the radiator fan 3 which is driven to rotate at either the predetermined high rotation speed or the predetermined low rotation speed is actually achieved or not. Thus, the failure diagnosing apparatus in the preferred embodiment can diagnose whether the cooling effect desired by the radiator fan 3 is actually exhibiting or not without specifying a source of the failure.

It is noted that although, in the embodiment, the failure diagnosis based on the continuation time for which the engine coolant temperature is continued to indicate the excessively high engine coolant temperature and that based on the engine coolant temperature rise speed are individually used according to the control modes of the radiator fan 3 (the high rotation speed and the low rotation speed), the diagnosing apparatus according to the present invention may carry out either one of the failure diagnoses or alternatively may carry out the failure diagnosis to determine whether the excessively high engine coolant temperature rise speed occurs in the high rotation speed mode in which the radiator fan 3 is driven to rotate at the predetermined high rotation speed.

Next, another preferred embodiment of the failure diagnosing apparatus and method according to the present invention will be described below. It is noted that the structure of the radiator fan control system to be diagnosed is the same as shown in FIG. 1.

Figure 8:
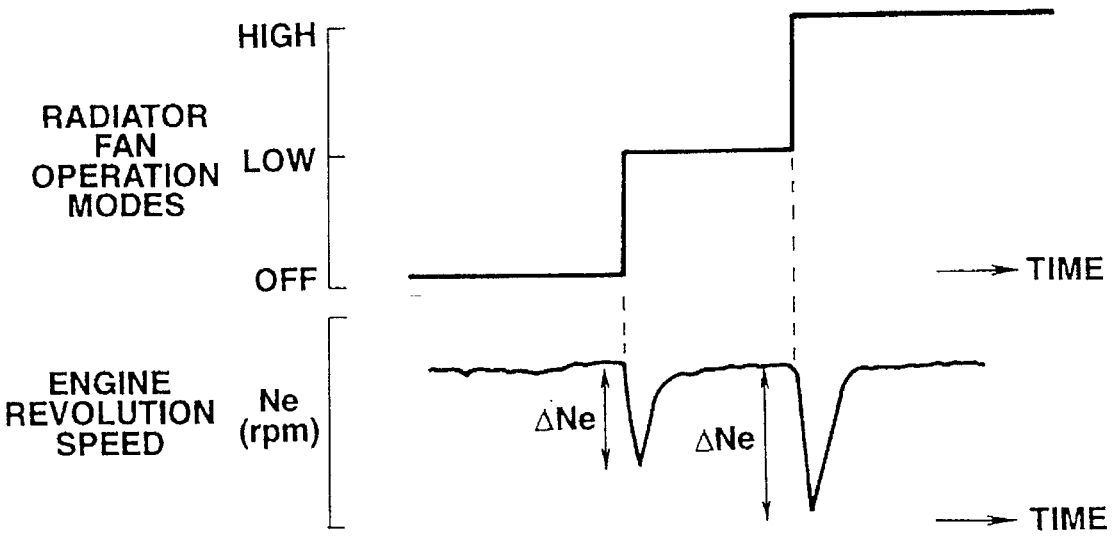
FIG. 8 is a signal timing chart of operation modes of the radiator fan rotations for explaining a correlation between the radiator fan and a revolution speed variation.

FIG. 8 shows an explanatory view for explaining a variation (drop) in an engine driving condition due to each of the changes in the radiator fan operation (control) modes.

The radiator fan 3 is, as shown in FIG. 1, driven to rotate by means of the DC motor 1 which is an electrical load to the engine. Thus, when the control unit 5 energizes either of the relay parts 4*a* or 4*b* to supply either the predetermined high or low voltage to the DC motor 1 to start the rotation thereof from the DC motor 1 stopped state or when the control unit 5 energizes either of the relay parts to render the radiator fan 3 in the predetermined low rotation speed state or the predetermined high rotation speed state (this mode change is referred to as a rotation speed switching control), the electrical load applied to the engine is incrementally varied. The incremental change in the electrical load results in the reduction in the driving conditions such as an engine revolution speed Ne, engine torque, and the vehicular battery voltage (refer to FIG. 8).

Hence, it is possible to diagnose the radiator fan control system on the basis of the variation width in the engine revolution speed Ne, the engine torque, or battery voltage generated along with the above-described rotation speed switching control.

Figure 7:
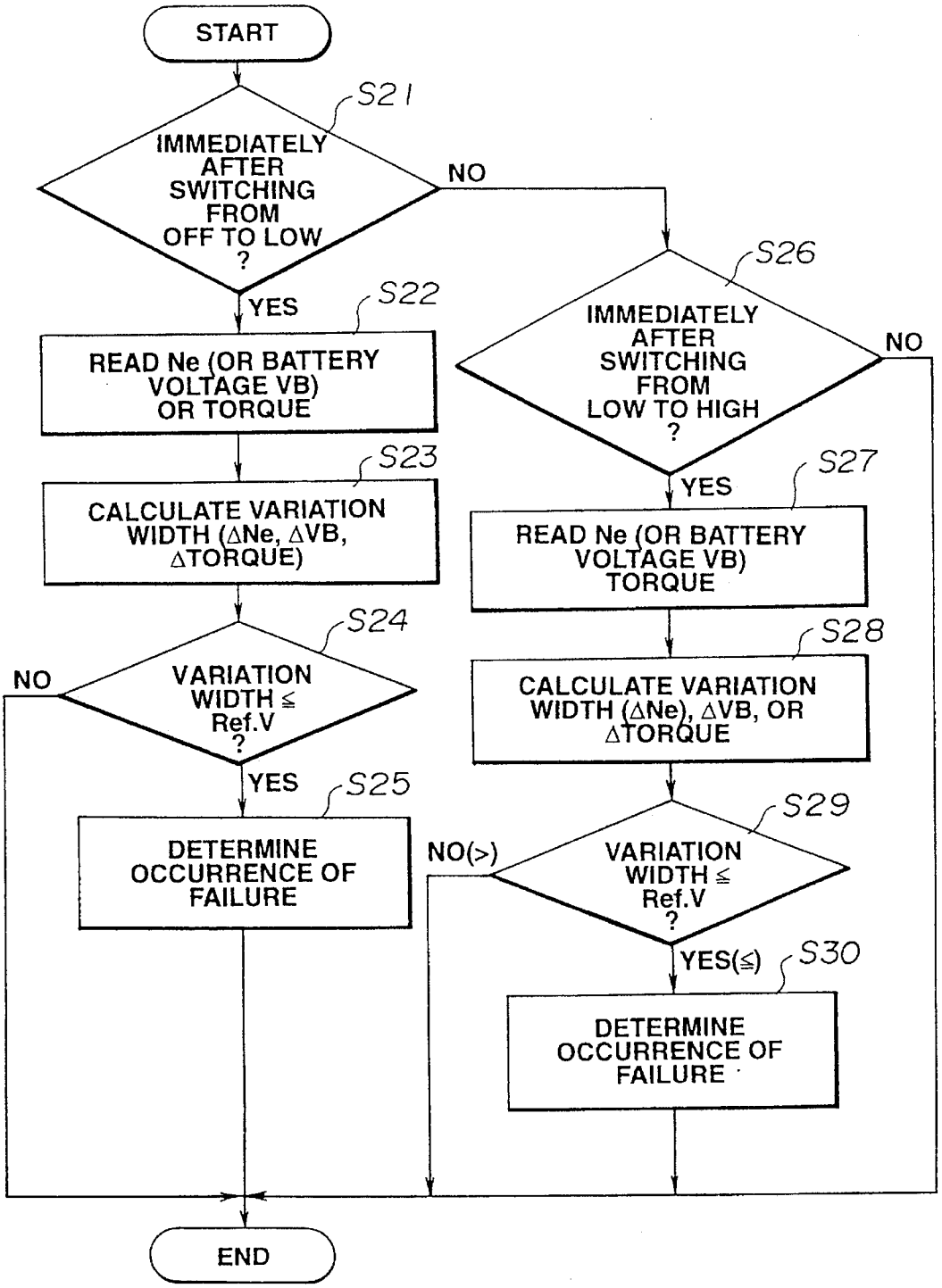
FIG. 7 is another operational flowchart representing a diagnosing operation in the diagnosing apparatus and method in another preferred embodiment for diagnosing the radiator fan control system.

FIG. 7 shows an operational flowchart executed in the control unit 5 to carry out the failure diagnosis in the radiator fan control system, as the other embodiment, on the basis of the drop in the engine revolution speed Ne detected by the revolution speed sensor 9 shown in FIG. 1.

In FIG. 7, at a step S21, the CPU 5*b* determines whether it is the time immediately after the voltage supply to the DC motor 1 has changed from zero to the predetermined low voltage so that the radiator fan rotation speed is changed from the stopped state to the predetermined low rotation speed with the relay part 4*b* turned to the on state.

If Yes at the step S22, the CPU 5*b* reads the engine revolution speed Ne.

At a step S23, the CPU 5*b* calculates a depth of the drop in the engine revolution speed ΔNe (engine driving condition variation width) along with the on state in the relay part 4*b* as a difference between the engine revolution speed Ne immediately before the relay part 4*b* is energized to supply the predetermined low voltage to the DC motor 1 and that Ne immediately after the relay part 4*b* is energized to supply the predetermined high voltage to the DC motor 1 (refer to FIG. 8). It is noted that the variation in the engine output torque or the variation in the terminal voltage across the vehicular battery VB may be detected in place of the above-described engine revolution speed Ne.

Next, at a step S24, the CPU 5*b* determines whether the drop depth ΔNe of the revolution speed Ne calculated at the step S23 is above a reference value of the drop previously set so as to correspond to the speed switching control modes from the stopped state to the predetermined low rotation speed control mode.

The reference value Ref. V at the step S24 is a value set on the basis of the drop depth of the revolution speed Ne generated when the DC motor 1 is normally operating to drive the radiator fan 3. Therefore, when the DC motor 1 is normally operated, the drop depth of the engine revolution speed Ne is set so as to exceed the reference value, i.e., No at the step S24.

If the drop of the engine revolution speed Ne exceeding the predetermined value is generated, it can deemed that the DC motor 1 is rotated up to the predetermined low speed so that the electrical load to the engine is increased. However, when the drop depth a Δ Ne is below the reference value Ref. V, it can be deemed that although the relay part 4*b* is energized to supply the predetermined low voltage to the DC motor 1, the increase in the electrical load to the engine is actually found. In this case, the routine goes to a step S25 since the CPU 5*b* determines at the step S24 that the rotation of the radiator fan 3 cannot be carried out by means of the DC motor. At the step S25, the CPU 5*b* outputs the failure determination signal indicating that the radiator fan control system has failed.

On the other hand, if the CPU 5*b* determines that it is not the time immediately after the DC motor 1 is switched from the stopped state to the predetermined low rotation speed control state (NO at the step S21), the routine goes to a step S26 in which the CPU 5*b* determines, in turn, whether it is the time immediately after the control mode of the radiator fan control system is switched from the predetermined low rotation speed control state to the predetermined high rotation speed control state (refer to FIG. 8).

Then, if it is the time immediately after the control mode of the radiator fan control system has changed from the predetermined low rotation speed mode to the predetermined high rotation speed mode (YES at the step S26), the routine goes to a step S27. At the step S27, the CPU 5*b* reads the engine revolution speed Ne.

At the step S28, the CPU 5*b* calculates the drop depth ΔNe of the engine revolution speed Ne in the same way as the step S23.

At the next step S29, the CPU 5*b* compares the drop depth ΔNe calculated at the step S28 with another reference value Ref. V previously set so as to correspond to the switching control mode from the predetermined low rotation speed control mode to the predetermined high rotation speed control mode.

If at the step S29 the CPU 5*b* determines that no such a drop in the engine revolution speed as to exceed the other reference value ref. V, the electrical load change in the DC motor 1 which corresponds to the switching control from the predetermined low rotation speed control mode to the predetermined high rotation speed control mode does not occur and the routine goes to a step S30.

At the step S30, the CPU 5*b* outputs the failure determination signal to the warning lamp 10 to turn on to indicate that the radiator fan control system has failed.

It is noted that the same steps as the steps S26 through S30 may be executed (steps S21A to S25A in FIG. 10A and steps S31 through S35 in FIG. 10B) during the switching control from the stopped state of the DC motor 1 to the predetermined high rotation speed control state provided that the reference value Ref. V is previously set so as to correspond to the switching control mode from the stopped state to the predetermined high rotation state.

Figure 10A:
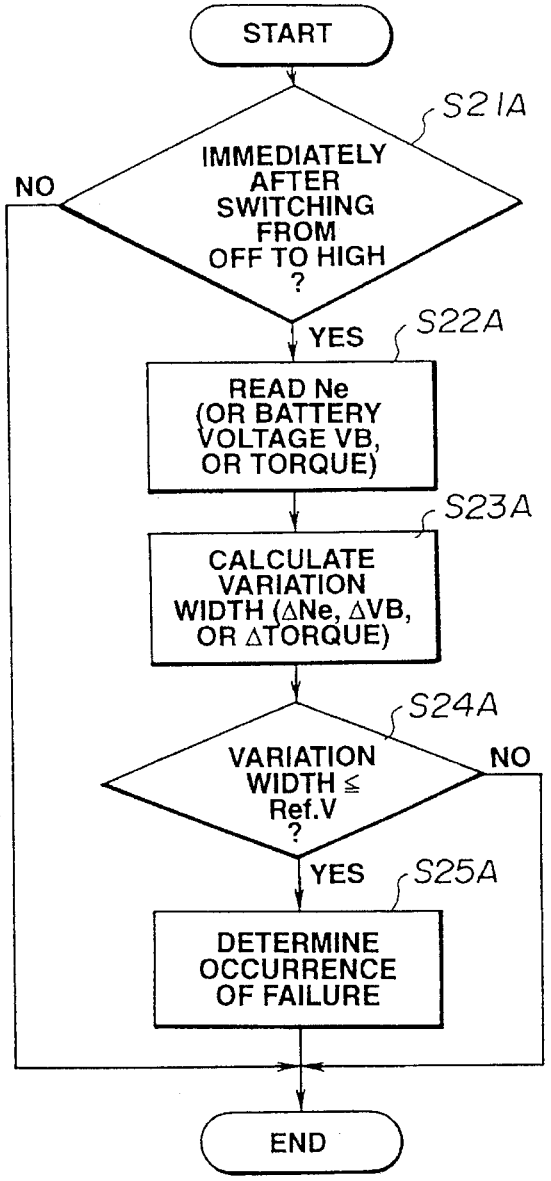
FIG. 10A and FIG. 10B are alternative operational flowcharts for explaining diagnostic operations in the diagnosing apparatus and method in the other preferred embodiment according to the present invention.
Figure 10B:
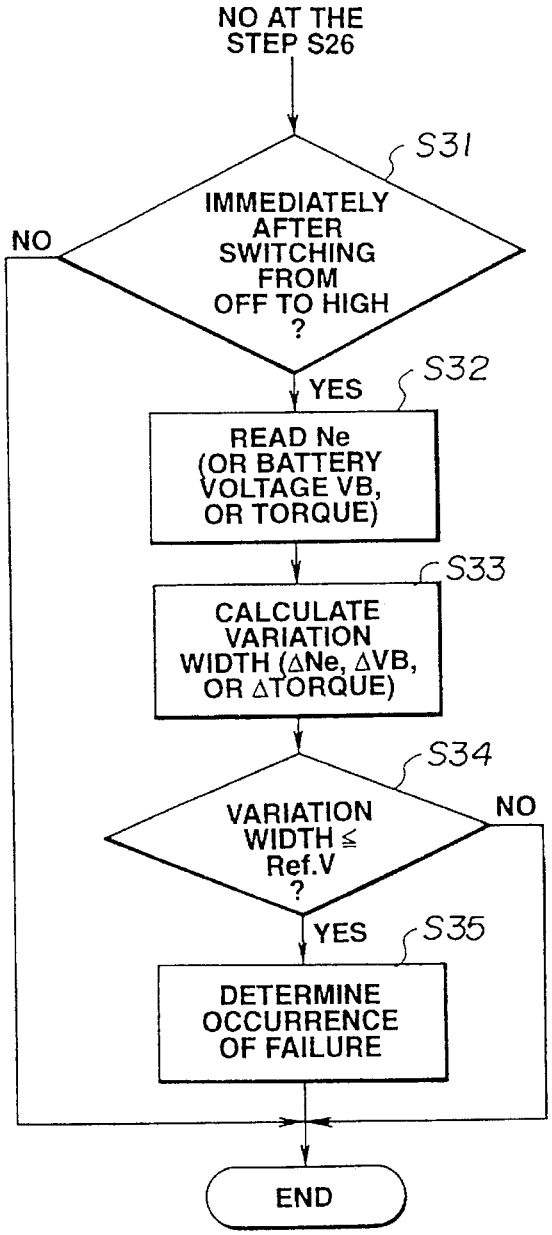

FIGS. 10A and 10B show the above-described diagnostic operations when the mode of the radiator fan control system is changed from the stopped state to the predetermined high rotation speed state.

As described above, since the diagnosing apparatus according to the present invention diagnoses whether the electrical load to the engine by means of the DC motor 1 is changed with either of the relay part 4*a* or 4*b* turned on, the self-diagnosis of whether the rotation of the DC motor 1 is actually controlled corresponding to the rotation speed control mode irrespective of the source of failure can be carried out. Therefore, when the rotation speed switching control is carried out, the failure such that the rotation speed of the radiator fan 3 is actually not controlled can accurately be diagnosed.

Figure 9:
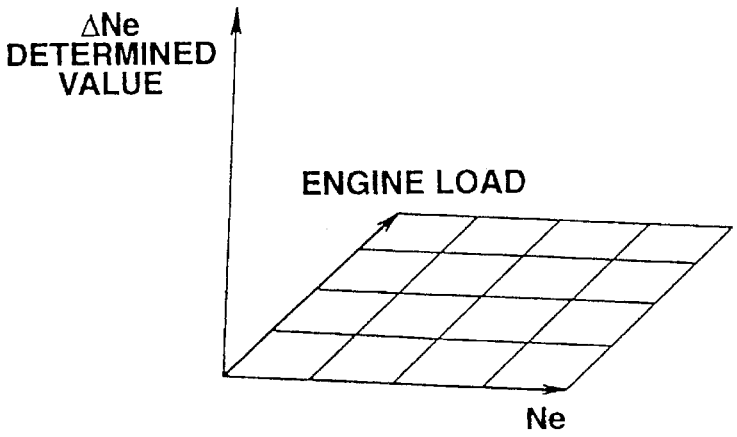
FIG. 9 is a table map view representing a reference value of the rotation variation in the DC motor installed in the radiator fan control system.

It is noted that the reference values Ref. V to determine the drop depth ΔNe of the engine revolution speed at the steps S24, S28, S24A, and S34 may previously be stored in the memory 5*c* of the control unit 5 for each engine driving condition divided by the engine load and engine revolution speed, as shown in FIG. 9, according to the modes of the rotation switching controls, i.e., (OFF (stopped state) →Low, OFF →High, and Low →High).

This is because even when the same variation in the electrical load to the engine occurs, its influence on the engine revolution speed Ne is different according to the engine driving condition. As the engine driving state falls in a lower load and/or lower engine revolution, a larger drop depth a Ne in the engine revolution speed occurs. Hence, the failure diagnosis based on the drop in the engine revolution speed described above may be limited to the engine driving state in which the engine load is relatively low and the engine revolution speed is relatively low.

As shown in FIGS. 7, 10A, and 10B, the drop Δ Ne in the engine revolution speed Ne may be replaced with a drop ΔVB in the vehicular battery VB since the variation in the electrical load to the engine along with the control for the DC motor 1 also appears as the variation in the battery voltage VB. Therefore, the reference values at the steps S24, S29, S24A, and S34 may be changed to those values related to the drop ΔVB in the battery voltage VB In addition, as shown in FIGS. 7, 10A, and 10B, the drop ΔNe in the engine revolution speed Ne may be replaced with a drop Δtorque in the engine output torque torque since the incremental variation in the electrical load to the engine along with the switching control for the DC motor 1 causes the generation of the torque loss. Therefore, the reference values at the steps S24, S24A, S29, and S34 may be changed to those values related to the drop Δtorque in the engine output torque torque.

Although, in the embodiment, radiator fan control system in which the rotation speed of the radiator fan 3 is changed into three modes, namely, the stopped state, the predetermined low rotation speed state, and high rotation speed state, the radiator fan control system in which the rotation speed is changed into two modes, namely, the stopped state and the predetermined high or low rotation speed state. Alternatively, the present invention is applicable to another radiator fan control system in which the rotation speed is changed into four or more states.

It is noted that the term of variation width used in FIGS. 7, 10A, 10B is the same as that of the drop depth used in the specification.

Various types of embodiments and modifications can be made within the scope of the present invention which will be defined by the appended claims.

What is claimed is:

1. A diagnostic apparatus for a radiator fan control system, said radiator fan control system having a radiator fan which is so constructed and arranged on a vehicular internal combustion engine as to cool an engine coolant of the engine and a DC motor which is so constructed and arranged on a shaft of the radiator fan as to drive the radiator fan to rotate to effectively cool the engine coolant, said diagnostic apparatus comprising:

a) coolant temperature detecting means for detecting a coolant temperature of the engine and outputting a signal indicative of the detected coolant temperature;

b) radiator fan control means for controlling a fan speed of the radiator fan on a basis of the detected coolant temperature indicative signal; and c) failure diagnosing means for outputting a failure determination signal indicating that the radiator fan control system has failed when the detected coolant temperature indicative signal indicates a predetermined temperature rise state.

2. A diagnostic apparatus for a radiator fan control system as claimed in claim 1, which further includes a warning lamp which is turned on when the failure determination signal is output from said failure diagnosing means.

3. A diagnostic apparatus for a radiator fan control system as claimed in claim 2, wherein said failure diagnosing means comprises detecting means for detecting whether or not a rise speed of a coolant temperature is equal to or above a reference value of a temperature rise, as the predetermined temperature rise state, and for outputting the failure determination signal when the detected rise speed of the coolant temperature equal to or above the reference value.

4. A diagnostic apparatus for a radiator fan control system as claimed in claim 2, wherein said failure diagnosing means comprises detecting means for detecting whether a continuation time during which the failure determining means is equal to or above a reference value of the continuation time, as the predetermined temperature rise state, and for outputting the failure determination signal when the detected rise speed of the coolant temperature is equal to or above the reference value.

5. A diagnostic, apparatus for a radiator fan control system as claimed in claim 3, which further comprises: means for detecting an ambient temperature; and means for detecting a vehicular speed, and wherein the reference value of the temperature rise speed is varied on a basis of least one of the ambient temperature and the vehicular speed.

6. A diagnostic apparatus for a radiator fan control system as claimed in claim 4, which further comprises: means for detecting an ambient temperature; and means for detecting a vehicular speed, and wherein the reference value of the continuation time is varied on a basis of least one of the ambient temperature and the vehicular speed.

7. A diagnostic apparatus for a radiator fan control system, said radiator fan control system having a radiator fan which is so constructed and arranged on a vehicular internal combustion engine as to cool an engine coolant of the engine and a DC motor which is so constructed and arranged on a shaft of the radiator fan as to drive the radiator fan to rotate to cool the engine coolant, said diagnostic apparatus comprising:

a) coolant temperature detecting means for detecting a coolant temperature of the engine and outputting a signal indicative of the detected coolant temperature;

b) radiator fan control means for controlling a fan speed of the radiator fan on a basis of the detected coolant temperature indicative signal;

c) engine driving condition detecting means for detecting a predetermined driving condition which is varied in correlation to a variation in an electrical load of the engine; and d) failure diagnosing means for determining whether or not a drop depth of the predetermined driving condition is below a reference value of the drop depth when a radiator fan speed is switched from a first operation mode to a second predetermined operation mode and for outputting a failure determination signal indicating that the radiator fan control system has failed when the drop depth of the predetermined driving condition is below the reference value of the drop depth.

8. A diagnostic apparatus for a radiator fan control system as claimed in claim 7, wherein said predetermined driving condition includes at least one of engine revolution speed, torque, and vehicular battery voltage.

9. A diagnostic apparatus for a radiator fan control system as claimed in claim 8, wherein the reference value of the drop depth is set according to at least one of the detected engine driving condition and the first or second radiator fan speed control modes in a switching control by means of the radiator fan control system.

10. A diagnostic apparatus for a radiator fan control system as claimed in claim 9, wherein the switching control of the radiator fan speed includes a stopped state of the DC motor, a predetermined low rotation state of the DC motor, and a predetermined high rotation state of the DC motor.

11. A diagnostic method for a radiator fan control system, said radiator fan control system having a radiator fan which is so constructed and arranged on a vehicular internal combustion engine as to cool an engine coolant of the engine and a DC motor which is so constructed and arranged on a shaft of the radiator fan as to drive the radiator fan to rotate to effectively cool the engine coolant, said diagnostic method comprising the steps of:

a) detecting a coolant temperature of the engine and outputting a signal indicative of the detected coolant temperature;

b) controlling a fan speed of the radiator fan on a basis of the detected coolant temperature indicative signal; and c) outputting a failure determination signal indicating that the radiator fan control system has failed when the detected coolant temperature indicative signal indicates a predetermined temperature rise state.

12. A diagnostic method for a radiator fan control system as claimed in claim 11, wherein the diagnostic method further comprises the step of d) turning on a warning lamp to inform a vehicular occupant of an occurrence of failure in the radiator fan control system.

13. A diagnostic apparatus for a radiator fan control system, said radiator fan control system having a radiator fan which is so constructed and arranged on a vehicular internal combustion engine as to cool an engine coolant of the engine, and a Direct Current motor which is so constructed and arranged on a shaft of the radiator fan as to drive the radiator fan to rotate to effectively cool the engine coolant, said diagnostic apparatus comprising:

a) coolant temperature detecting means for detecting a coolant temperature of the engine and outputting a signal indicative of the detected coolant temperature;

b) radiator fan control means for controlling a fan speed of the radiator fan on a basis of the detected coolant temperature indicative signal; and c) failure diagnosing means for diagnosing a failure in the radiator fan control system and outputting a failure determination signal indicating that the radiator fan control system has failed when the detected engine coolant temperature indicates either that a time duration from a time at which the detected engine coolant temperature has exceeded a predetermined coolant temperature continues for a predetermined period of time or that a rise rate of the coolant temperature per unit of time has decreased below a predetermined rate.

14. A diagnostic method for a radiator fan control system, said radiator fan control system having a radiator fan which is so constructed and arranged on a vehicular internal combustion engine as to cool an engine coolant of the engine, and a Direct Current motor which is so constructed and arranged on a shaft of the radiator fan as to drive the radiator fan to rotate to effectively cool the engine coolant, said diagnostic method comprising the steps of:

a) detecting a coolant temperature of the engine and outputting a signal indicative of the detected coolant temperature;

b) controlling a fan speed of the radiator fan on a basis of the detected coolant temperature indicative signal; and c) diagnosing a failure in the radiator fan control system and outputting a failure determination signal indicating that the radiator fan control system has failed when the detected engine coolant temperature indicates either that a time duration from a time at which the detected engine coolant temperature has exceeded a predetermined coolant temperature continues for a predetermined period of time or that a rise rate of the coolant temperature per unit of time has decreased below a predetermined rate.

* * * * *